United States Patent [19]

Grimshaw et al.

[11] 4,232,091

[45] Nov. 4, 1980

[54] COMPOSITE MATERIALS AND THEIR PRODUCTION

[75] Inventors: Rex W. Grimshaw, Rawdon; Colin Poole, Castleford, both of England

[73] Assignee: Hepworth & Grandage Limited, Bradford, England

[21] Appl. No.: 40,862

[22] Filed: May 21, 1979

[30] Foreign Application Priority Data

May 26, 1978 [GB] United Kingdom ..... 23438/78

[51] Int. Cl.[3] ..... B32B 15/04; B32B 15/14; B32B 15/20; B22D 19/02

[52] U.S. Cl. ..... 428/472; 106/73.4; 75/DIG. 1; 164/91; 164/97

[58] Field of Search ..... 428/472; 164/91, 97; 75/DIG. 1; 106/73.4

[56] References Cited

U.S. PATENT DOCUMENTS 3,547,180 12/1970 Cochran et al. ..... 75/DIG. 1

3,828,839 8/1974 Dhingra ..... 164/97

4,012,204 3/1977 Riewald et al. ..... 75/DIG. 1

*Primary Examiner*—Earl C. Thomas

*Assistant Examiner*—Mark Bell

*Attorney, Agent, or Firm*—Brisebois & Kruger

[57] ABSTRACT

A composite material of aluminum or an aluminum alloy, reinforced with a fiber or whisker form of unmodified alumina. The material is produced by preheating a mould and a mat of unmodified alumina to a temperature in the range of 700° C. to 1050° C. Molten aluminum or its alloy free of elements which react with the alumina are introduced into the mould to cover the mat. A pressure of at least 75 Kg/cm$^2$ is applied to the contents of the mould to overcome the surface tension between the alumina and the molten mass of metal and to cause the molten mass to fully penetrate the alumina mat. Upon solidification of the molten aluminum, the composite material is obtained.

14 Claims, No Drawings

COMPOSITE MATERIALS AND THEIR PRODUCTION

This invention relates to a process for the production of composite materials comprising aluminium or an aluminium alloy containing, as a reinforcing material, a fibrous or whisker mat of alumina.

Various attempts have already been made to reinforce aluminium and aluminium alloy materials so as to increase their strength. A number of these attempts have included the use of different forms of alumina as the reinforcing material. The main difficulty which has been encountered is that molten aluminium and its alloys do not readily "wet" alumina either in single crystal or polycrystalline form. [see Wolf et al, Chem. Eng. Prog. Volume 62 (3) pages 84–78 (1966)].

One approach to the problem has been first to coat the alumina with a metal which forms a volatile derivative such as nickel and tungsten (both of which form volatile carbonyls), chromium (which forms a volatile dicumene derivative) titanium or copper. Sequential coating with two of these metals has also been carried out. A uniform mixture of metal coated alumina in fibrous or whisker form is then prepared, placed in a mould and hot pressed in the solid state but the combined effect of the temperature and the pressure was chosen to be such that partial liquifaction of the metal would occur during the pressing operation. Materials so produced have shown variation in properties in different parts of the specimens and have shown marked porosity which has increased with increase in the percentage of alumina reinforcing material used and is a source of reduced matrix strength. Hot pressing temperatures up to 425° C. have been used in this work.

Another approach to this problem has been the use of molten aluminium alloys containing 1–8% by weight of lithium (British patent no. 1506476) with either continuous filament or discontinuous fibres of polycrystalline alumina. Such filaments and fibres may be provided with a thin coating of silica thus enabling aluminium alloys of lower lithium content to be used. In such a system a reaction takes place between the lithium in the alloy and the surface of the filaments and fibres and the surface becomes grey to black and it is important to ensure that not more than 20% of the diameters of the fibres is involved. Thus the intermediate sheath serves to bond the alumina filaments and/or fibres to the aluminium or alloy thereof. A pressure differential of 2 to 14 lbs/in$^2$ is applied to overcome any resistance of the molten metal to penetrate the alumina structure. The composites produced by this process inevitably contain lithium.

It is an object of the present invention to provide a process for the production of a composite material based upon the use of unmodified alumina fibres and/or whiskers.

According to the present invention there is provided a process for the production of a composite material comprising aluminium and/or an aluminium alloy and a fibrous or whisker mat of alumina as a reinforcing material which comprises introducing into a mould containing a mat of unmodified fibrous and/or whisker form alumina, which mould and contents have been preheated to a temperature between 700° and 1050° C., molten aluminium and/or an aluminium alloy with one or more alloying elements which is/are unreactive towards alumina at the temperature of introduction not exceeding 1050° C. until said mat is covered with molten metal, varying the pressure over the contents of said mould to overcome the surface tension between alumina and molten metal and thus ensure that the molten metal penetrates the interstices of said mat, and allowing the molten metal to solidify in contact with said mat.

The alumina used in the present process may either be a single crystal form of alumina or a polycrystalline form thereof. The single crystal forms of alumina are substantially pure α-alumina. The production of such a form of alumina whiskers is described and claimed in British Pat. No. 1489346 and U.S. Pat. No. 3,947,562. When a fibrous form of alumina is used it is a high strength, high modulus polycrystalline fibrous material which is essentially α-alumina. Typical products are described in U.S. Pat. Nos. 3,808,015 and 3,853,688. All such alumina may be regarded as forms of artifically produced alumina.

In the present process modification of the fibres or whiskers, for example by forming a surface coating of one or other metals is avoided. The fibres or whiskers are used as produced and do not undergo any modification prior to use in the present process.

The matrices contain aluminium or an alloy of aluminium with one or more elements which do not react with α-alumina under the temperature conditions envisaged. The primary alloying element is either silicon or a metal such as magnesium, copper, zinc, tin, manganese, nickel or iron. The alloys used may be different types of casting alloys e.g. general purpose alloys, heavy duty alloys or special purpose alloys. A useful list of such alloys is given in British Standards Specification No. 1490 (1970) pages 12 and 13. Most of these alloys include one or more of silicon, copper, magnesium, manganese and nickel as the essential alloying elements but may additionally contain small quantities of a number of other metals which are either impurities unavoidably present or are special purpose additives e.g. titanium.

In the composite materials prepared by the process of the present invention the aluminium or aluminium alloy constitutes a major proportion of the product by weight. Preferably the composite consists of at least 85% by weight of aluminium or aluminium alloy, the balance being fibres or whiskers of α-alumina. In many cases the composite will consist of at least 90% by weight of aluminium or aluminium alloy with the balance α-alumina in fibrous and/or whisker form. Sufficient fibres and/or whiskers should be used to increase the strength of the composite to be produced when compared with that of metal free from such reinforcing material. Expressed in another way the volume ratio of alumina to metal can be up to 20%.

The process of the invention is conveniently carried out in an electric furnace provided with means for applying a vacuum and means for applying pressure, such as a hydraulic ram. The mould containing the charge of unmodified fibres and/or whiskers of α-alumina is placed within the furnace and preheated to a temperature between 700° C. and 1050° C. Meanwhile substantially pure aluminium metal or an aluminium alloy is separately heated until it is molten, and preferably to at least 50° C. above its melting point. The molten metal is then poured into the preheated mould and over the charge in the furnace. The temperature of the aluminium or alloy should not be so high that it attacks the unmodified alumina fibres and/or whiskers. Alumina fibres sometimes contain small proportions of other oxides such as magnesia and this may have to be taken into account in determining a suitable temperature for the molten metal. With given starting materials a few trial runs will readily indicate a convenient temperature range for the molten metal. The whole of the charge should be delivered in molten condition into the preheated mould before the further procedure commences.

Typical temperature conditions when pure aluminium is used are to pour this at a temperature of 900°-950° C. and to have the mat of unmodified alumina preheated to 800°-850° C. When an aluminium-silicon base alloy is used the temperatures may be somewhat lower e.g. the mat of unmodified alumina may be at 800°-850° C. and the molten alloy at 850°-900° C. It will be seen that it is preferred to have the molten metal at a higher temperature than the unmodified alumina.

Pressure is next applied to the contents of the mould by forcing the piston of the hydraulic ram into contact with the molten metal in the mould. Substantial pressures are thus applied to the surface of the molten metal and these force the molten metal into the interstices of the unmodified alumina mat and overcome the surface tension between the metal and the mat. The metal and the unmodified alumina thus become directly bonded. It is preferred to evacuate the interior of the mould prior to applying pressure. This ensures that pockets of air are not present in the molten metal in the mould or during the operation of the hydraulic ram. The molten metal is then allowed to solidify about the alumina matt and thus produce a reinforced cast body. The solid casting can then be removed from the mould.

The pressures used in this process are substantial. In experiments we have used pressures of 75-375 kg/cm$^2$ to obtain satisfactory results. Higher pressures can be used when suitable equipment is available but do not appear to be necessary. The use of lower pressures will largely depend upon the amount of reinforcement desired and the consequent degree of separation of the individual fibres and/or whiskers of alumina. Our experience is that it is desirable to use a minimum pressure of 75 kg/cm$^2$.

There is an interrelation between temperature of the material in the mould and the applied pressure. When the temperature of the material is about 700° C. pressures as high as 375 kg/cm$^2$ are needed to obtain a satisfactory result but at temperatures of about 850° C. the applied pressure need not exceed 75 kg/cm$^2$.

The present procedure involves bringing the molten metal, the mat of fibres and/or whiskers of alumina and the mould containing the mat to temperatures above that at which the molten metal commences to solidify and this, under the applied pressure, brings about direct contact between molten metal and the mat of alumina without chilling of the molten metal to solidification temperatures. Indeed the mould and the alumina mat can be at a higher temperature than the molten metal at the time of contact. A reaction at the alumina-molten metal interface can occur if the temperatures of the materials are unduly high. This reaction does not appear to occur to an appreciable extent at temperatures up to 1050° C. Thus this is the upper limit of temperature but it is preferred to work at temperatures not exceeding 950° C. Whilst the nature of the molten metal will affect the choice of temperatures it is usually preferred to operate at 700°-900° C. The nature of the bond which forms at the interface is not at present understood.

The following examples illustrate the nature of the invention.

EXAMPLE 1

Commercially pure aluminium was used in this Example. No independent analysis was made but the specification for the product indicated a purity of greater than 99.7% by weight. The procedure of British Pat. No. 1489346 was used to provide a matt of crystalline alumina whiskers and this was placed in a graphite lined mould. The mould containing the alumina whiskers was heated in an electric vacuum furnace provided with a plunger to a temperature of 800°-850° C. Simultaneously sufficient of the commercially pure aluminium to cover the matt of whiskers was heated to about 950° C. and the molten metal was then poured on to the whiskers at a temperature between 900° and 950° C. The plunger which was centred over the mould was partially lowered, all gases were drawn off by operation of a vacuum pump, the plunger was then fully lowered so as to apply a pressure of 75 kg/cm$^2$ to the surface of the molten aluminium. The piston end of the plunger used had a graphite surface. When a constant reading of applied pressure had been recorded for several minutes the plunger was withdrawn and the contents of the mould were allowed to cool before being withdrawn from the furnace. Examination of the product showed that the molten aluminium had penetrated into the interstices of the alumina mat and through to the graphite lining of the mould.

EXAMPLE 2

The procedure of Example 1 was repeated using in place of commercially pure aluminium, a heavy duty aluminium alloy containing about 1.0% by weight of magnesium, 1.1% of silicon and 0.7% of manganese which was heated to about 900° C. The applied pressure was about 110 kg/cm$^2$. Similar results were obtained.

EXAMPLE 3

The procedure of Example 1 was repeated using, in place of commercially pure aluminium, a special purpose aluminium alloy containing about 1.2% by weight of copper, 1.3% of magnesium and 11.5% of silicon which was heated to about 850° C. whilst the mould and mat of whiskers were heated to about 775° C. and the applied pressure was about 225 kg/cm$^2$. Similar results were obtained.

EXAMPLE 4

The procedure of Example 1 was repeated using, in place of commercially pure aluminium, an aluminium based alloy containing 1.2% of magnesium and 2.2% of nickel, which was heated to about 850° C. whilst the mould and mat of whiskers were heated to about 775° C. and the applied pressure was about 200 kg/cm$^2$. Similar results were obtained.

EXAMPLE 5

The procedure of Example 3 was repeated using, in place of the mat of alumina whiskers, tows of commercial continuous alumina filaments aligned in a graphite lined mould. The alloy used, temperature of heating and pressure applied were the same as those used in Example 3. Tested showed that considerable reinforcement was obtained.

The products of the present process have an exceptionally low porosity for products of this type: the porosities are between 1 and 2%. in addition the product exhibit very good tensile strength and high temperatures. The products are very uniform in properties.

We claim:

1. A process for the production of a composite material comprising aluminium or an aluminium alloy reinforced with a mat of alumina which comprises (a) introducing into a mould containing a mat of unmodified alumina in fibre or whisker form, said mould and said mat having been preheated to a temperature in the range of 700° C. to 1050° C., a molten mass of aluminium or of an alloy of aluminium free from any element which reacts with alumina in said temperature range in an amount sufficient to cover said mat with molten metal after application of pressure thereto, said aluminium or alloy being at a temperature below that at which said fibres or whiskers are attacked thereby (b) directly applying to the contents of said mould sufficient mechanically applied pressure to overcome the surface tension between said unmodified alumina and said molten mass and thereby ensuring that said molten mass fully penetrates the interstices of said alumina mat, said applied pressure being at least 75 kgm/cm$^2$, and (c) allowing said molten aluminium or alloy thereof to solidify in contact with said unmodified alumina mat.

2. The process of claim 1 in which the pressure over the contents of said mould is first reduced in order to degas the contents of said mould and is then increased to a value of at least 75 kg/cm$^2$ until penetration of the interstices of said mat of unmodified alumina is complete.

3. The process of claim 1 in which the pressure over the contents of said mould is increased to a value in the range of 75 to 375 kg/cm$^2$.

4. The process of claim 1 in which said aluminium alloy is an aluminium/silicon based alloy which is heated to a temperature in the range of 850° to 900° C. and the mould and matt of unmodified alumina is preheated to a temperature within the range of 750° to 800° C.

5. The process of claim 1 in which aluminium is heated to a temperature in the range of 900° to 950° C. and the mould and mat of unmodified alumina is preheated to a temperature within the range of 850° to 900° C.

6. The process of claim 1 in which said unmodified alumina is a whisker form thereof in which each whisker is a single crystal.

7. The process of claim 1 in which said unmodified alumina is a fibre form of unmodified alumina.

8. The process of claim 1 in which said unmodified alumina is an artificially produced form of $\alpha$-alumina.

9. A composite material comprising aluminium or an aluminium alloy reinforced with a fibre or whisker form of unmodified alumina which has been produced by a process which comprises (a) introducing into a mould containing a mat of unmodified alumina in fibre or whisker form, said mould and said mat having been preheated to a temperature in the range of 700° C. to 1050° C., a molten mass of aluminium or of an alloy of aluminium free from any element which reacts with said alumina in said temperature range in an amount sufficient to cover said mat with molten metal after application of pressure thereto, said aluminium or alloy being at a temperature below that at which said fibres or whiskers are attacked thereby (b) directly applying to the contents of said mould sufficient mechanically applied pressure to overcome the surface tension existing between said unmodified alumina and said molten mass and thereby ensuring that said molten mass fully penetrates the interstices of said alumina mat, said applied pressure being at least 75 kg/cm$^2$, and (c) allowing said molten aluminium or alloy thereof to solidify in contact with said unmodified alumina mat.

10. The composite material of claim 9 in which the pressure over the contents of said mould is first reduced in order to degas the contents of said mould and is then increased to a value of at least 75 kg/cm$^2$ until penetration of the interstices of said mat of unmodified alumina has taken place.

11. The composite material of claim 9 in which the mould and mat of unmodified alumina contained therein is preheated to a temperature within the range of 750° to 800° C. and an aluminium/silicon based alloy having a temperature of 850° to 900° C. is poured thereonto.

12. The composite material of claim 9 in which the mould and mat of unmodified alumina contained therein is preheated to a temperature in the range of 850° to 900° C. and aluminium having a temperature of 900° to 950° C. is poured thereonto.

13. The composite material of claim 9 in which said unmodified alumina is a whisker form in which each whisker is a single crystal.

14. The composite material of claim 10 in which said unmodified alumina is a fiber form of unmodified alumina.

* * * * *